US005125719A

United States Patent [19]

Snyder

[11] Patent Number: 5,125,719

[45] Date of Patent: Jun. 30, 1992

[54] TUNNEL BORING MACHINE AND METHOD

[76] Inventor: Larry Snyder, 12395 W. 53rd Ave. #G-06, Arvada, Colo. 80002

[21] Appl. No.: 677,161

[22] Filed: Mar. 29, 1991

[51] Int. Cl.[5] ..... E21D 9/10; F16C 32/06

[52] U.S. Cl. ..... 299/31; 384/101

[58] Field of Search ..... 299/31, 55, 58; 384/101, 102, 121, 124

[56] References Cited

U.S. PATENT DOCUMENTS

| | | | |
|---|---|---|---|
| 3,332,726 | 7/1967 | Cooper | 384/101 |
| 3,383,138 | 5/1968 | Scaravilli et al. | 299/31 |
| 3,640,573 | 2/1972 | Safar | 299/31 |
| 3,713,700 | 1/1973 | Montacie | 299/31 |
| 4,189,186 | 2/1980 | Snyder | 299/31 |

*Primary Examiner*—David J. Bagnell
*Attorney, Agent, or Firm*—Brian D. Smith

[57] ABSTRACT

A tunnel boring machine having increased thrust capability is disclosed. The machine includes a rotatable cutter head for cutting material away from the face of the tunnel and a drive shaft and motor for rotating the cutter head in a cutting state of operation. A bearing assembly is also provided for facilitating rotation of the cutter head during the cutting state of operation. Thrust cylinders are also provided for generating forward thrust. The machine also includes first and second structures for defining a fluid pressurizable cavity between the cutter head and the thrust cylinders which transmit forward thrust to the cutter head when the cavity is sufficiently pressurized. In addition, the machine includes a pressurizing system for pressurizing the cavity.

14 Claims, 4 Drawing Sheets

Fig_6
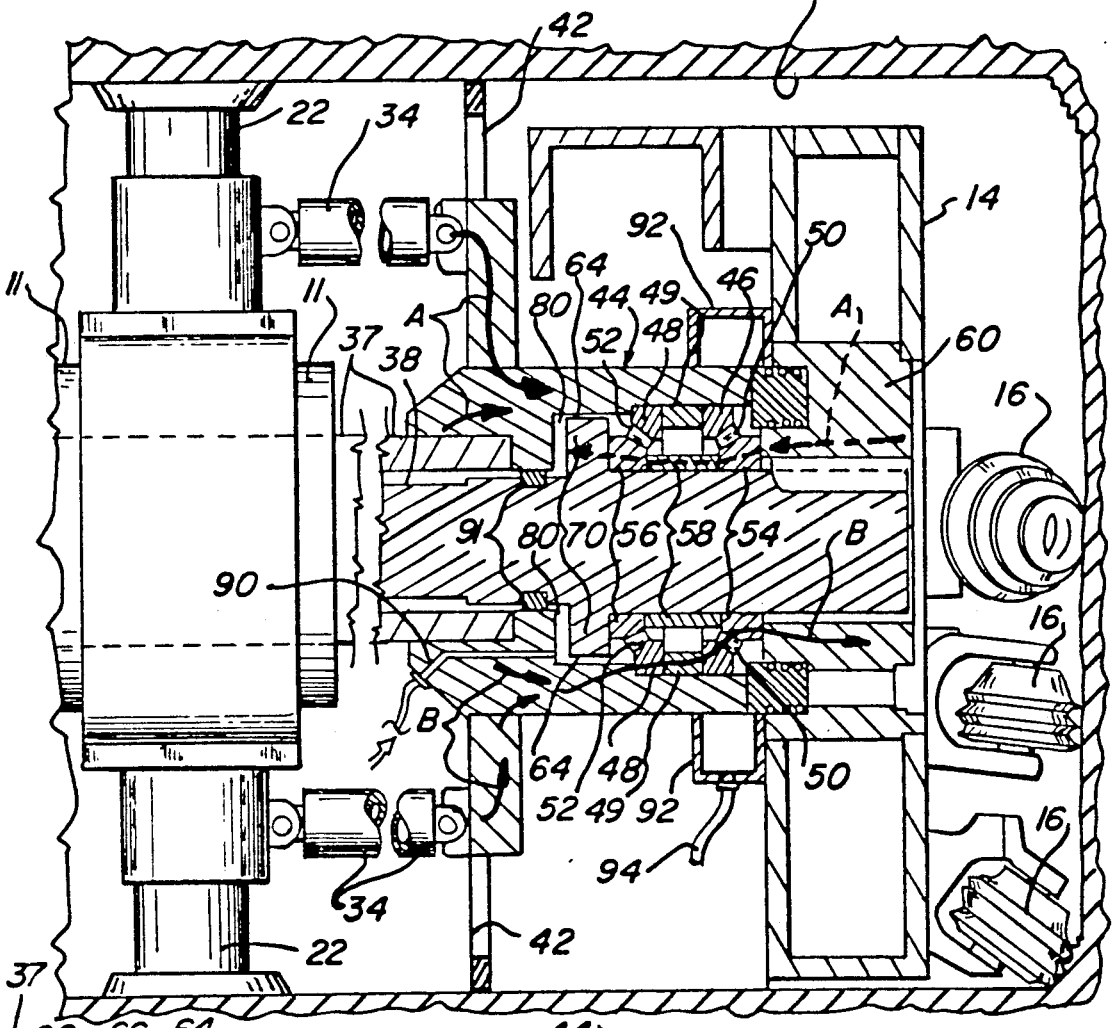
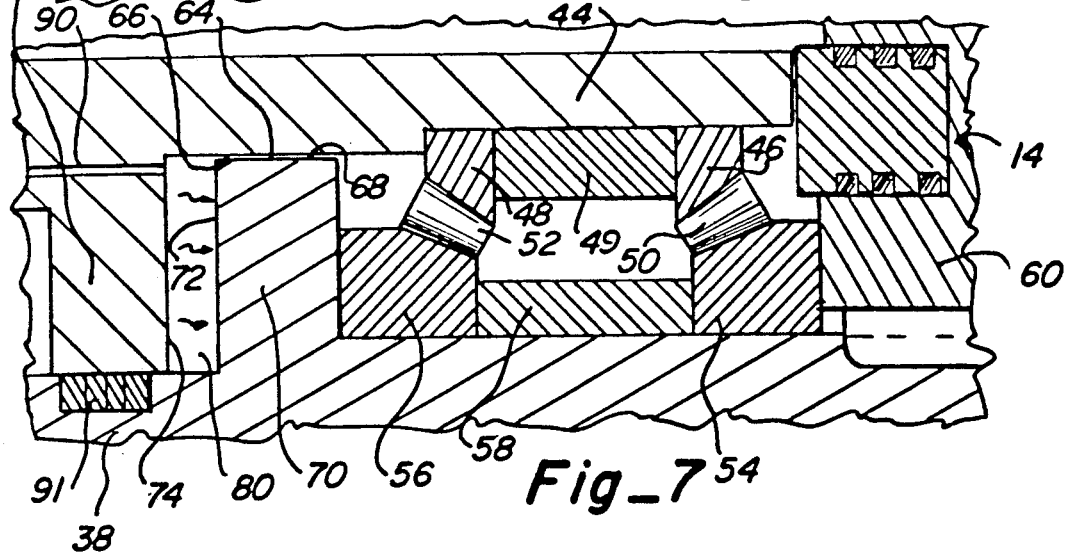
Fig_7

TUNNEL BORING MACHINE AND METHOD

TECHNICAL FIELD

The invention relates generally to tunnel boring methods and machines and, more particularly, to a tunnel boring method and machine having greatly increased thrust capability.

BACKGROUND OF THE INVENTION

While the thrust capability of tunnel boring machines has increased greatly in the past ten years, there still remains a need for tunnel boring machines having significantly greater thrust capability. The difficulty of increasing thrust capability is attributable to the relatively low load capacity of the machines' thrust bearings which are like the weak link in a chain in that all thrust generated by today's machines is transmitted to the cutter head through the thrust bearings. Because of this problem, a lot of attention has been directed towards increasing the thrust bearings' load capacity. For example, research has been conducted into making the bearings out of higher quality steels, steepening the cone angles of the bearings and using three roller race bearing designs. None of this research, however, is expected to significantly increase the bearing's load capacity. Twenty to forty percent increases are possible but 100 percent increases are believed to be out of the question. The bearings' load capacity problem also cannot be solved by simply making the bearings larger. Those who have ever squeezed past the bearing housings on hard rock tunnel boring machines know that larger main thrust bearings cannot be installed due to space limitations.

An object of the present invention is to significantly increase a tunnel boring machine's thrust capability without increasing the size of the machine's thrust bearings.

Another object of the present invention is to retrofit existing tunnel boring machines to increase the machine's thrust capability.

Yet another object of the present invention is to increase the thrust capability of existing machines at a low cost without having to replace the machine's existing thrust bearings.

Yet another object of the present invention is to provide a tunnel boring machine that does not have to transmit thrust to the cutter head through the machine's thrust bearings.

Yet another object of the present invention is to provide a tunnel boring method for increasing the speed of tunnel boring.

DISCLOSURE OF THE INVENTION

The present invention increases the thrust capability of a tunnel boring machine by hydrostatically force balancing the thrust bearings so that the bearings' load capacity is not exceeded. In fact, by hydrostatically force balancing the thrust bearings it is actually possible to take all load off the thrust bearings and yet still increase, i.e. dramatically increase, the machine's thrust capability.

The tunnel boring machine of the present invention includes conventional rotatable cutter head means having a central axis of rotation for cutting material away from the face of a tunnel and rotation means for rotating the cutter head means. The machine also includes conventional thrust generating means for generating forward thrust and bearing means positioned in substantially coaxial relationship with the cutter head means central axis of rotation for facilitating rotating the cutter head means in a cutting state of operation. In addition, the tunnel boring machine of the present invention includes cooperating first and second structure means for defining a fluid pressurizable cavity between the first and second structure means which transmits thrust generated by the thrust generating means to the cutter head means when it is sufficiently pressurized. The tunnel boring machine also includes pressurization means for sufficiently pressurizing the cavity with fluid, preferably lubricating fluid, so that the forward thrust generated by the thrust generating means is transmitted to the cutter head means.

On existing machines having thrust bearings for thrust transmission, the pressurizable cavity of the present invention is preferably located between the cutter head means and the support structure for the main thrust bearing means. By sufficiently pressurizing the cavity, the thrust bearings can be hydrostatically force balanced so that their load capacity cannot be exceeded. In fact, when the cavity is sufficiently pressurized all thrust generated by the machine's thrust generating means can be transmitted directly to the cutter head means through the cavity, thereby taking the entire load off the main bearings.

The advantages provided by hydrostatic transfer of the thrust forces are significant. For example, extremely high thrust forces can now be generated without overloading the thrust bearings. It is also possible to take all load off the thrust bearings, thereby reducing bearing friction which will increase bearing life. It may even be possible to eliminate conventional thrust bearings, or at least replace them with smaller bearings. Those skilled in the art will appreciate that the thrust capability of tunnel boring machines can be doubled or tripled by the present invention. In fact, a machine's pressurizing limitations are expected to be the only significant constraints limiting future increases in machine thrust capability.

A preferred embodiment of the invention includes means for preventing the pressurizing fluid in the cavity from overheating. In a particularly preferred embodiment of the present invention fluid overheating is prevented by defining the pressurizable cavity so that it is capable of controllably leaking hydraulic fluid which is collected, cooled and recycled to the cavity. The fluid is recycled to the cavity at a temperature which prevents it from overheating while it is in the cavity.

The present invention also provides a method of tunnel boring which enables the speed of tunnel boring to be increased. The method includes the steps of providing a tunnel boring machine having a rotatable cutter head for cutting material away from the face of the tunnel and rotation means for rotating the cutter head during a cutting state of operation. The machine also includes thrust generating means for generating forward thrust and bearing means for facilitating rotation of the cutter head during the cutting state of operation. The machine further includes first and second structure means for defining a fluid pressurizable cavity which is capable of transmitting forward thrust generated by the thrust generating means to the cutter head when the cavity is sufficiently pressurized. The method further includes a step of positioning the machine so that the machine's cutter head is in position to bore a desired tunnel. In addition, the method includes pressurizing the pressurizable cavity so that forward thrust generated by the thrust generating means is transmitted to the cutter head. The method further includes rotating the cutter head and generating forward thrust so that material is cut away from the face of the tunnel.

BRIEF DESCRIPTION OF THE DRAWINGS

Other features will appear in the following description and appended claims, reference being made to the accompanying drawings forming a part of the specification where like reference characters designate corresponding parts in the views.

FIG. 6 is a partial, broken away, cross-sectional view of the tunnel boring machine of FIG. 1.

FIG. 7 is an enlarged, partial cross-sectional view of a portion of that illustrated in FIG. 6.

DETAILED DESCRIPTION OF PREFERRED EMBODIMENT

FIGS. 1-7 illustrate a bearing cone rotation type tunnel boring machine 10 having a support frame 11. Machine 10 is similar to the Mark series tunnel boring machines manufactured by Jarva, Inc. of Solon, Ohio. Machine 10 is also similar to that described in U.S. Pat. No. 4,189,186 to Snyder which is hereby incorporated by reference and which should be referred to for details of machine 10 which are not described herein and are not inconsistent with that described herein.

Figure 1:
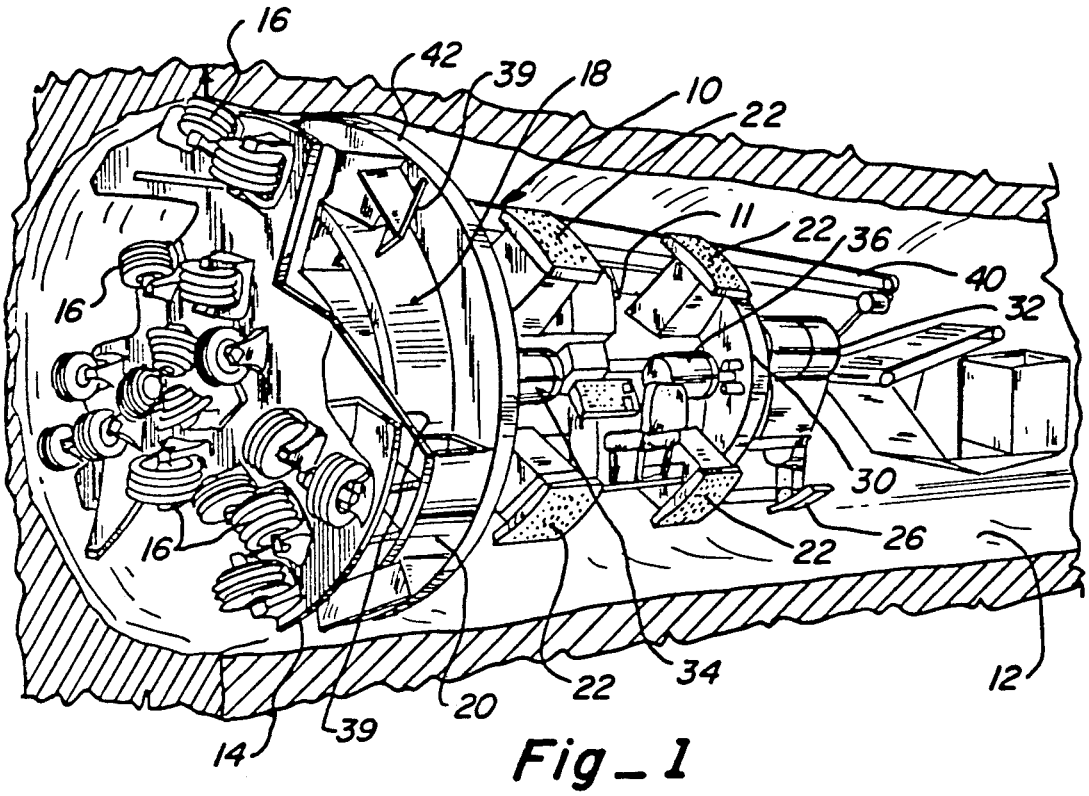
FIG. 1 is a perspective view of a tunnel boring machine of the present invention located in a tunnel.

As illustrated in FIG. 1, machine 10 is located in a tunnel 12 with its cutter head 14 located against the face (not shown) of the tunnel. The machine's cutter head 14 is provided with conventional cutters 16 for cutting material away from the face of the tunnel as the cutter head rotates. A conventional muck ring 18 and muck bucket 20 for collecting the cuttings are also provided.

Machine 10 also has conventional clamp legs 22 for anchoring the machine to the tunnel's wall 24 and lift legs 26 for supporting the machine when the clamp legs are retracted to advance the machine forward. In addition, machine 10 includes conventional cutter head rotation means (partially shown but not numbered) having a gear housing 30 and a motor/gear reducer 32 for rotating the cutter head in a cutting state of operation. Conventional front and rear thrust cylinders 34, 36 respectively and a thrust tube 37 (see FIG. 7) are also provided for transmitting forward thrust to the cutter head so that cutters 16 remain pressed against the tunnel's face as the cutter head is rotated. As one might expect, the speed of tunnel boring can be increased if the thrust generated by cylinders 34, 36 and tube 37 can be increased.

Figure 2:
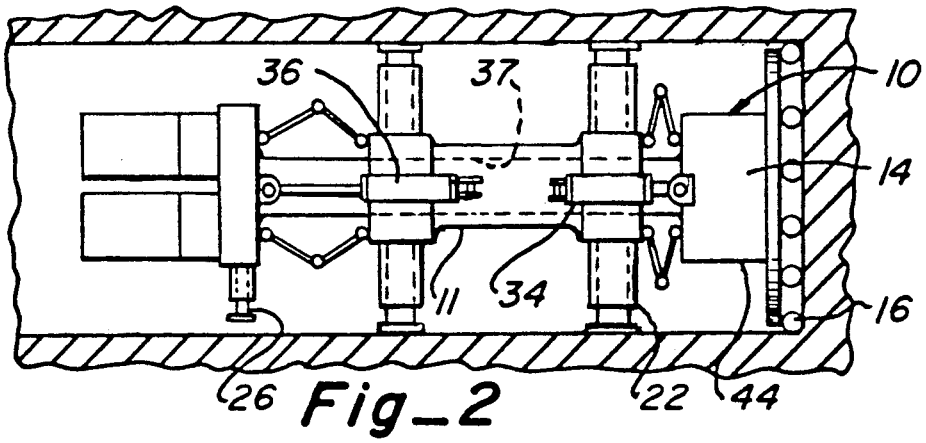
FIG. 2 is a side elevational view of the machine of FIG. 1 shown as it would appear in step 1 of its cycle for boring a tunnel.
Figure 3:
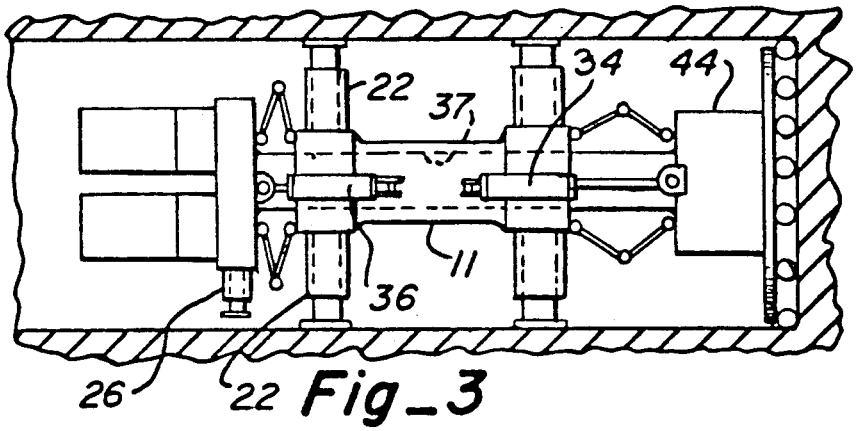
FIG. 3 is a side elevational view of the machine of FIG. 1 shown as it would appear in step 2 of its cutting cycle.

FIGS. 2-6 illustrate the four steps involved in one cutting cycle of machine 10. FIG. 2 illustrates step one of the cycle wherein clamp legs 22 are anchored against the tunnel wall with lift legs 26 retracted. Machine 10 bores in this position until the end of the advance stroke is reached as such is illustrated in FIG. 3. The machine bores by driving its drive shaft 38 (see FIG. 6) to rotate the cutter head in a clockwise direction as viewed from the rearward portion of the tunneling machine facing forwardly. As the cutter head rotates, thrust cylinders 34 and thrust tube 37 are advanced forwardly to force cutters 16 against the tunnel end face to cut or crush the formation being encountered. Unlike the cutter head and drive shaft, thrust tube 37 is restrained against rotation (relative to frame 11) by a plurality of keys (not shown) which are fixed to tube 37 and receivable in a corresponding number of keyways (not shown) fixed to the bore of the support frame 11.

The cuttings which accumulate in the bottom of the tunnel bore as the tunnel is bored are deflected by plows 39 into muck buckets 20 as the cutter head rotates. As the bucket rotates from the lower portion of the tunnel to the upper portion of the tunnel, the contents of the bucket are dropped onto a conveyor 40 to convey the material to the rear of the machine. To confine dust to the area of the machine adjacent the cutter head, a dust shield 42 is also preferably provided.

Figure 4:
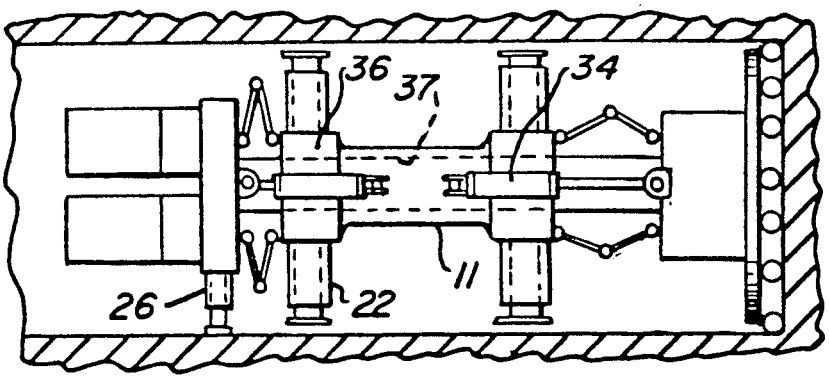
FIG. 4 is a side elevational view of the machine of FIG. 1 shown as it would appear in step 3 of its cutting cycle.
Figure 5:
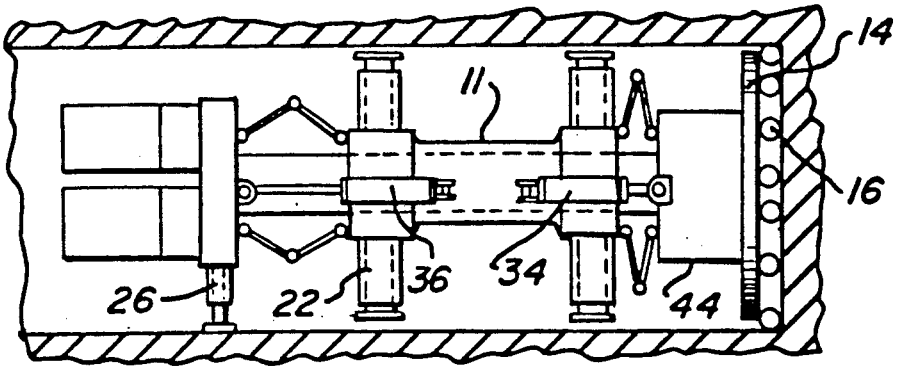
FIG. 5 is a side elevational view of the machine of FIG. 1 shown as it would appear in step 4 of its cutting cycle.

At the end of the advance stroke, the lift legs 26 are extended to support the weight of the machine while the clamp legs are retracted from their anchoring position as such is illustrated in FIG. 4. The body of the machine including the clamp legs are then advanced forward by retracting thrust cylinders 34 as such is illustrated in FIG. 5. The clamp legs 22 are then extended to the anchor position and the lift legs are retracted as illustrated in FIG. 2. The machine is now ready to commence another cutting cycle.

As best illustrated in FIGS. 6 and 7, the forward end of thrust tube 37 carries an enlarged bearing housing 44 which supports front and rear bearing cups 46 and 48, respectively, of the main thrust bearing assembly (not numbered). Bearing cups 46 and 48 are separated by a spacer 49. The bearing assembly also includes front and rear bearing rollers 50 and 52, respectively, which are supported by front and rear bearing cones 54 and 56, respectively. The bearing cones are separated by a bearing cone spacer 58 and the cones and spacer are secured to the outer surface of a cutter head hub portion 60 of drive shaft 38, which extends through thrust tube 37 to journal the drive shaft for rotation with respect to the thrust tube. The bearing assembly is supplied with lubricant through an annular clearance 64 which is defined by an inner surface 66 of bearing housing 44 and an outer surface 68 of a flange portion 70 of drive shaft 38.

In accordance with an important aspect of the present invention, a flange portion 70 (sometimes referred to herein as first structure means) of drive shaft 38 and bearing housing 44 (sometimes referred to herein as second structure means) cooperate to define (by their respective surfaces 72 and 74) a pressurizable cavity 80 of machine 10. When sufficiently pressurized with a viscous fluid (such as 90 to 140 weight lubricating gear oil), cavity 80 transmits forward thrust generated by thrust tube 37 and thrust cylinders 34, 36 to cutter head 14. The actual path of the transmission of forward thrust is shown in the dotted line identified by arrow A in FIG. 6. As shown, the thrust passes through bearing housing 44, pressurized cavity 80, flange portion 70, rear bearing cones 56, bearing cone spacer 58 and front bearing cones 54 before it reaches a central portion 82 of cutter head 14.

Those skilled in the relevant art will appreciate that by transmitting the thrust through cavity 80 of the present invention, much of the load (i.e. thrust) is taken off bearing rollers 50 and 52, particularly the front bearing rollers 50 which would have transmitted the thrust if cavity 80 were not pressurized. The path of thrust transmission if cavity 80 is not pressurized (or only partially pressurized) is shown in the line identified by arrow B in FIG. 6. As shown, the thrust passes through bearing housing 44, rear bearing cups 48, spacer 49, front bearing cups 46, front roller bearings 50 and front bearing cones 54 before it reaches cutter head 14.

By pressurizing cavity 80 and taking part or all of the load off the bearings, those skilled in the relevant art will appreciate that the life of the bearing components can be significantly increased. It will also be appreciated that the pressurized cavity can transmit much more thrust to the cutter head than the bearings can. This is because conventional bearings have low load capacities and will fail if more thrust is transmitted through them than they are capable of handling. The bearings are like the weak link in a chain in that no more thrust can be generated than the bearings can handle. Accordingly, those skilled in the relevant art will appreciate that by properly pressurizing cavity 80, thrust transmission can be greatly increased. In fact, any amount of thrust can theoretically be transmitted to the cutter head as long as the pressurizing system's capacity is not exceeded.

Figure 8:
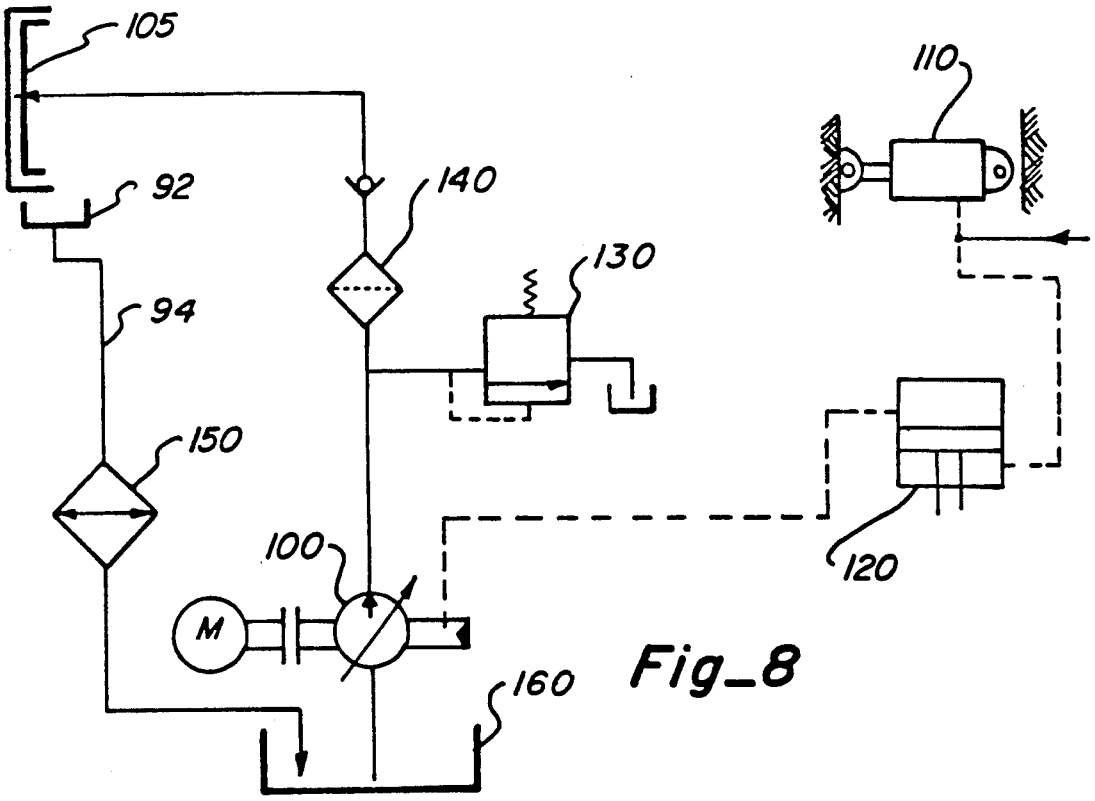
FIG. 8 is a schematic of a system which may be used to pressurize the pressurizable cavity of the present invention.

FIG. 8 is a schematic of a pressurizing system which may be used to pressurize cavity 80. Numeral 100 identifies a high pressure pump for pumping fluid, preferably 90 to 140 weight lubricating oil, under high pressure to pressurize a pressurizable cavity 105 such as cavity 80 of the embodiment illustrated in FIGS. 1-6. Numeral 110 refers to the thrust generating means such as thrust tube 37 and cylinders 34, 36 for providing the tunnel boring machine with forward thrust. Numeral 120 identifies a pressure proportioning valve which controls the degree to which the system is pressurized by pump 100. The proportioning valve is designed to control pump 100 so that the pressure or forces generated in pressurizable cavity 105 do not substantially exceed the thrust forces acting on the cutter head, i.e. those generated by the thrust generating means 110. While a pressure proportioning valve is disclosed in FIG. 8, other means for controlling the pressure could also be employed, such as electrical sensing means. Numeral 130 identifies a pressure safety valve which will activate to relieve the system of excess pressure when the forces generated in cavity 105 exceed a predetermined maximum limit. Numeral 140 identifies a filter for filtering dirt and other contaminants from the pressurized oil or fluid. Numeral 150 identifies a cooling means such as a water/oil or air/oil heat exchanger for cooling the pressurized fluid or oil. Numeral 160 identifies a reservoir in which fluid or oil collects and is drawn from by pump 100.

Returning to FIGS. 6 and 7, highly pressurized oil such as that generated by the system illustrated in FIG. 8, is pumped into cavity 80 through a conduit 90. Ring seal 91 is provided as illustrated between the drive shaft and bearing housing to prevent oil from leaking into the bore of thrust tube 37. Oil in accordance with an aspect of the present invention is permitted, however, to leak from cavity 80 through annular clearance 64. The oil leakage is controlled, however, so that cavity 80 can be pressurized as desired. To control oil leakage, annular clearance 64 is provided with a predetermined length and width which is sufficiently small so that the desired pressure can be generated in cavity 80.

After exiting annular clearance 64, the oil flows into the bearing assembly to lubricate the bearing cones, cups and rollers. The oil is then collected in a sump 92 attached to the bearing housing. The collected oil is then preferably channeled via a conduit 94 to a reservoir such as reservoir 160 of FIG. 8 and then to the high pressure pump such as pump 100 of FIG. 8. If desired, the oil may be first passed through a cooling means such as cooling means 150 of FIG. 8.

In addition to lubricating the bearing components, those skilled in the relevant art will appreciate that by circulating the oil through a pressurizing system such as that illustrated in FIG. 8 the oil can be replaced as necessary. The circulation of oil through cavity 80 also makes it easier to cool the oil and thereby reduce heat build up within the cavity.

On a twelve foot diameter tunnel boring machine, the annular clearance between the bearing housing and flange is expected to have a width measured as between surfaces 68 and 66 of between about ten and twenty thousandths of an inch. The length of the annular clearance on such a machine is expected to be between four and eight inches, preferably about five inches. Annular clearance length is measured by the width of flange portion 70 as defined by its surface 68. These dimensions are based on use of a 140 weight oil. These dimensions might have to be changed if an oil having a different viscosity is used.

While annular clearance 64 for leaking oil to the bearings is provided in the embodiment of FIGS. 1-7, this area, i.e. the clearance, could be sealed if desired with a high pressure ring seal such as a rubber lip seal or metallic shaft seal. This would make it possible to more highly pressurize cavity 80 which might make it possible to transmit more thrust to the cutter head.

Figure 9:
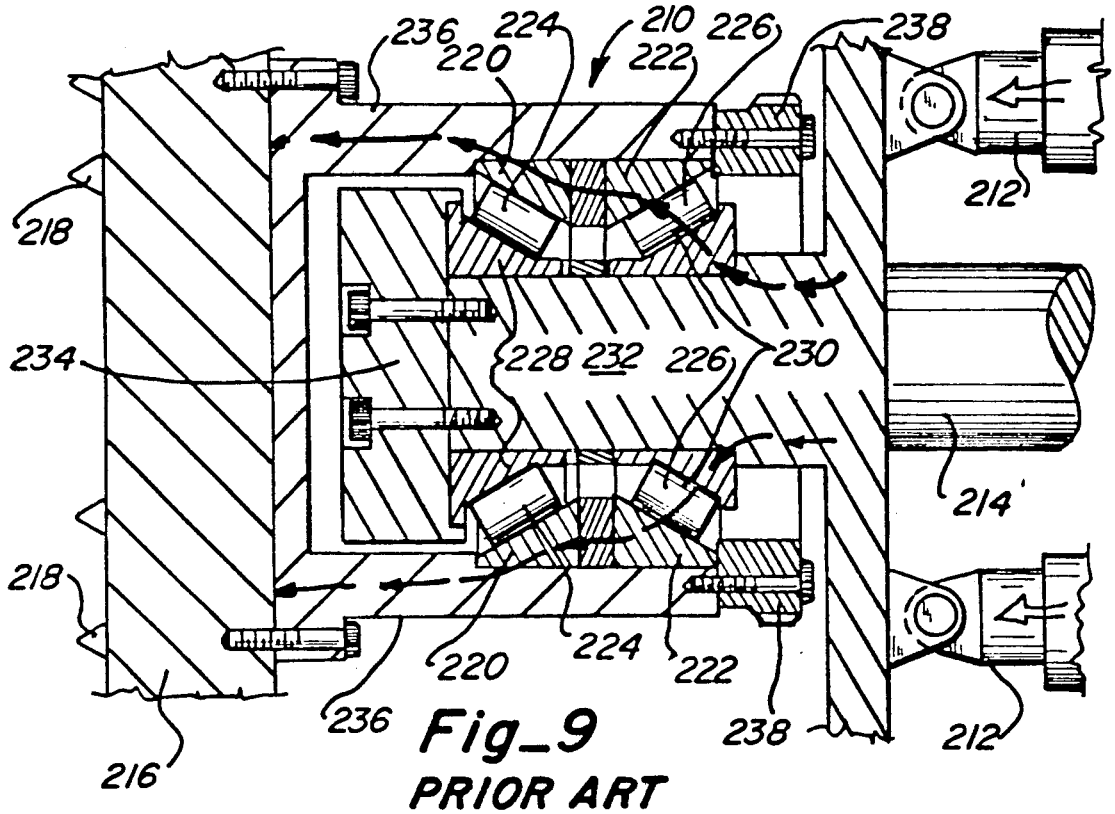
Fig 9 PRIOR ART
FIG. 9 is a partial, broken away, cross-sectional view of a conventional prior art bearing cup type rotated tunnel boring machine.

FIG. 9 illustrates the bearing assembly (and adjacent components) of a conventional bearing cup rotational type tunnel boring machine 210. A machine similar to machine 210 is described in U.S. Pat. No. 3,383,138 which is hereby incorporated by reference. Machine 210 has front thrust cylinders 212 (and rear thrust cylinders, not shown) and a thrust tube 214 for generating forward thrust which is transmitted through a bearing assembly (not numbered) to the machine's cutter head 216. Cutter head 216 has conventional cutters 218 which are illustrated generically.

The bearing assembly has conventional front and rear bearing cups 220 and 222, respectively; front and rear bearing rollers 224 and 226, respectively; and front and rear bearing cones 228 and 230, respectively.

The bearing cones are supported by a bearing support shaft 232 and are secured to shaft 232 by a bearing clamp 234 which is rigidly secured (i.e. bolted) to support shaft 232. Bearing shaft 232 is also rigidly attached to thrust cylinders 212 and tube 214.

The bearing cups are secured to a rotatable outer bearing housing 236 by a ring gear 238. The outer bearing housing 236 is, in turn, rigidly secured to cutter head 216. The cutter head and rotatable outer bearing are rotated to cut away material from the face of the tunnel by a conventional rotation means (not shown).

The front and rear bearing rollers 224, 226, are as illustrated conventionally supported for rolling movement between the bearing cones and cups. The rolling movement of the rollers occurs as the cutter head rotates which causes the bearing cups to rotate around the bearing cones which remain stationary.

The path of thrust transmission generated by the thrust cylinders and thrust tube is identified by the arrows shown in FIG. 9. As illustrated, the thrust passes through bearing support shaft 232, rear bearing cones 230, rear bearing rollers 226, rear bearing cups 222, bearing spacer 239 and front bearing cup 220 before it reaches the outer bearing housing 236 which is rigidly secured to the cutter head. It will be appreciated that the bearing rollers, particularly the rear bearing rollers, support and transmit all thrust generated by cylinders 212 and tube 214 and therefore must have a load capacity which is capable of handling the thrust forces generated by the thrust cylinders and thrust tube.

Figure 10:
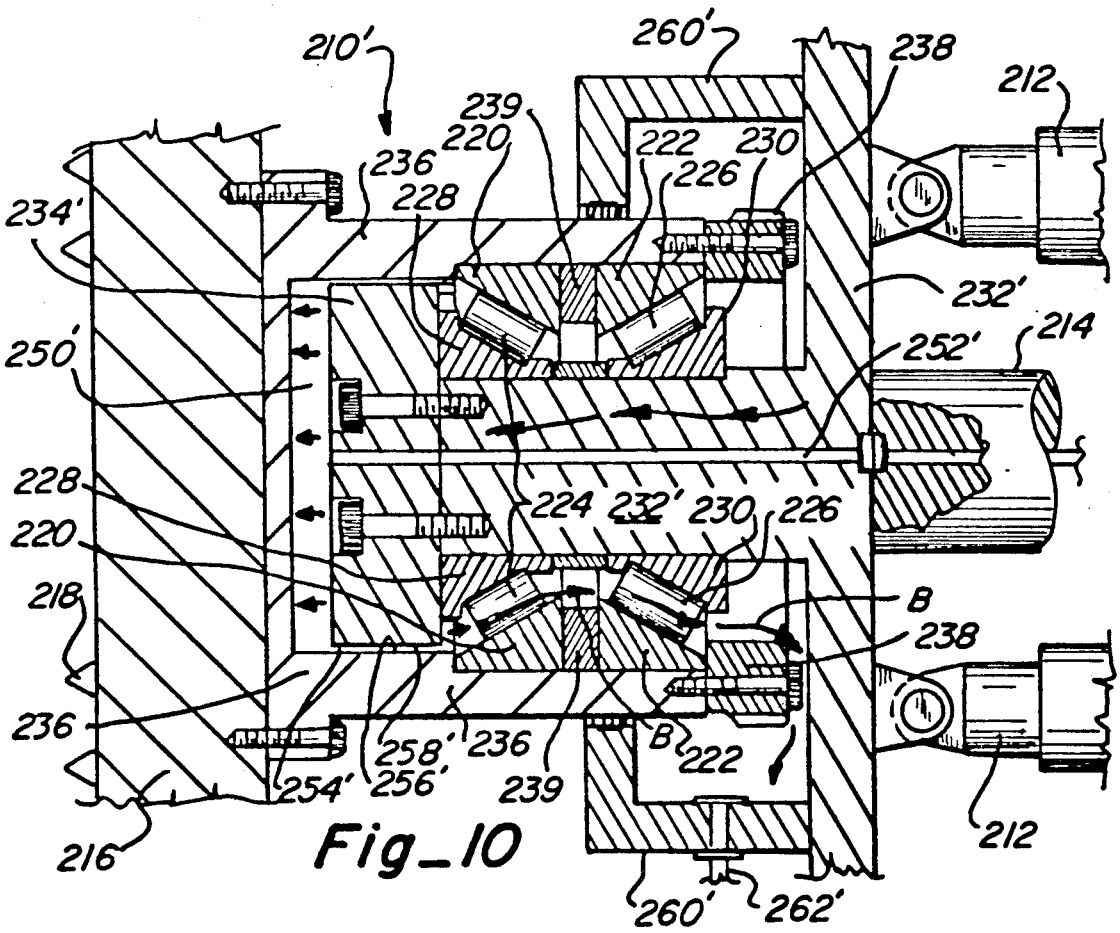
FIG. 10 is a partial, broken away, cross-sectional view of a machine similar to that illustrated in FIG. 9 which has been retrofitted in accordance with the present invention.

FIG. 10 illustrates machine 210 of FIG. 9 (identified by numeral 210') after it has been retrofitted in accordance with the present invention. The elements of machine 210' which are identical to those of machine 210 are identified by the same numerals. Those elements which are new or have been modified are identified by a primed numeral.

As illustrated in FIG. 10, retrofitted machine 210' includes a pressurizable cavity 250' located between and defined by outer bearing housing 236 (first structure means) and bearing clamp 234' (second structure means). When sufficiently pressurized, cavity 250' directly transmits the thrust generated by cylinders 212 and tube 214 to the cutter head, thereby bypassing the bearings. The arrows in FIG. 10 show the actual path of thrust transmission through machine 210' which, as illustrated, passes through bearing support shaft 232', bearing clamp 234', and pressurized cavity 250' before it reaches outer bearing housing 236 which is rigidly secured to cutter head 216.

Cavity 250' can be pressurized in accordance with the present invention by a pressurizing system similar to that illustrated in FIG. 8. The pressurizing system would pump fluid, preferably viscous lubricating gear oil having a viscosity of between 90 and 140 weight, through a bore 252' provided in and extending through the bearing support shaft 232' and bearing clamp 234'. While cavity 250 could remain sealed, it is preferably provided with an annular clearance 254' located between inner surface 256' of the outer bearing housing and surface 258' of the bearing clamp. In the illustrated embodiment, the bearing clamp's outside diameter and width are predetermined to provide the annular clearance with a predetermined length and width which enables the desired pressure to be generated in cavity 250'.

As with annular clearance 64 of the embodiment illustrated in FIGS. 1-7, annular clearance 254' leaks a predetermined amount of oil which flows into the bearing housing to lubricate the bearing assembly. The path of the oil exiting annular clearance 254' is shown by the arrows identified by the letter B in FIG. 10. After lubricating the bearings, the oil is collected in an annular sump housing 260' attached to the bearing support shaft as illustrated in FIG. 10. The oil collects in the bottom of the sump housing and is conveyed via a conduit 262' back to a reservoir and high pressure pump (not shown), such as reservoir 160 and pump 100, of the high pressure system illustrated in FIG. 8. The oil may also be cooled by a cooling means such as cooling means 150 illustrated in FIG. 8.

Those skilled in the relevant art will appreciate the ease with which a tunnel boring machine such as tunnel boring machine 210 can be retrofitted to provide it with the pressurizable cavity of the present invention. Those skilled in the relevant art will also appreciate the fact that extremely high thrust forces can now be transmitted directly to the cutter head without having to pass through the bearings. As a result, bearing life will be greatly increased. Moreover, future tunnel boring machines will be able to utilize smaller and less costly bearings; and yet still transmit more thrust to the cutter head than today's machines can. As a result, the speed at which tunnels can be bored will greatly increase.

While the invention has been described in connection with specific embodiments thereof, it is to be clearly understood that this is done only by way of example, and not as a limitation to the scope of the invention as set forth in the objects thereof and in the appended claims.

What Is claimed:

1. A tunnel boring machine comprising:

rotatable cutter head means having a central axis of rotation for cutting material away from the face of a tunnel to elongate the tunnel in a forward direction;

rotation means for rotating said rotatable cutter head means in a cutting state of operation;

thrust generating means for generating forward thrust;

bearing means for facilitating rotation of said cutter head means in a cutting state of operation;

cooperating first and second structure means for defining a fluid pressurizable cavity to transmit forward thrust generated by said thrust generating means to said cutter head means when said cavity is sufficiently pressurized; and pressurization means for sufficiently pressurizing said cavity with fluid so that forward thrust generated by the thrust generating means is transmitted to the cutter head means.

2. A tunnel boring machine comprising:

rotatable cutter head means having a central axis of rotation for cutting material away from the face of a tunnel to elongate the tunnel in a forward direction;

rotation means for rotating said rotatable cutter head means in a cutting state of operation;

thrust generating means for generating forward thrust;

bearing means positioned in substantially coaxial relationship with the central axis of rotation for facilitating rotation of said cutter head means in a cutting state of operation, said bearing means also being capable of transmitting forward thrust generated by said thrust generating means to said cutter head means;

cooperating first and second structure means for defining a fluid pressurizable cavity to transmit forward thrust generated by said thrust generating means to said cutter head means when said cavity is sufficiently pressurized; and pressurization means for pressurizing said cavity with fluid to control the amount of forward thrust transmitted to said cutter head means through said bearing means and through said cavity when said cavity is pressurized.

3. A tunnel boring machine as claimed in claim 2 wherein said fluid is a lubricating gear oil having a viscosity between about 90 to 140 weight.

4. A tunnel boring machine as claimed in claim 3 wherein said first and second structure means defining said cavity further defines an annular clearance between said first and second structure means for controllably leaking fluid from said cavity.

5. A tunnel boring machine as claimed in claim 4 wherein said pressurization means includes sump means for collecting fluid leaking from said cavity.

6. A tunnel boring machine as claimed in claim 4 wherein said annular clearance is sealed to prevent leakage.

7. A tunnel boring machine as claimed in claim 4 wherein said annular clearance is provided with a predetermined width and length.

8. A tunnel boring machine as claimed in claim 7 wherein the width of said annular clearance is between about 0.01 and 0.02 inches.

9. A tunnel boring machine as claimed in claim 7 wherein the length of said annular clearance is between about 4 and 8 inches.

10. A tunnel boring machine as claimed in claim 4 wherein said annular clearance is in fluid communication with said bearing means so that fluid exiting said annular clearance lubricates said bearing means.

11. A tunnel boring machine as claimed in claim 2 wherein said pressurization means includes high pressure pump means for supplying and pressurizing said cavity with viscous fluid.

12. A tunnel boring machine as claimed in claim 2 wherein said pressurizing means includes cooling means for cooling said fluid.

13. A tunnel boring machine as claimed in claim 2 wherein said pressurization means includes filtering means for filtering contaminants from the fluid.

14. A method of tunnel boring comprising:

providing a tunnel boring machine including:

a rotatable cutter head for cutting material away from the face of a tunnel;

rotation means for rotating the cutter head in a cutting state of operation;

thrust generating means for generating forward thrust;

bearing means for facilitating rotation of the cutting head during the cutting state of operation; and cooperating first and second structure means for defining a fluid pressurizable cavity to transmit the forward thrust generated by the thrust generating means to the cutter head when the cavity is sufficiently pressurized;

positioning the machine so that the machine's cutter head is in position to bore a desired tunnel;

pressurizing the pressurizable cavity so that forward thrust generated by the thrust generating means is transmitted to the cutter head; and rotating the cutter head and generating forward thrust so that material is cut away from the face of the tunnel.

* * * * *